United States Patent [19]

Petty

[11] 3,952,495

[45] Apr. 27, 1976

[54] TENSION PULLEY ASSEMBLY FOR TEXTILE SPINNING MACHINES

[75] Inventor: Robert H. Petty, Sanford, N.C.

[73] Assignee: Roberts Company, Sanford, N.C.

[22] Filed: Feb. 20, 1974

[21] Appl. No.: 443,972

[52] U.S. Cl. ..... 57/105

[51] Int. Cl.[2] ..... D01H 1/20

[58] Field of Search ..... 57/34 R, 105, 92, 93, 57/104

[56] References Cited

UNITED STATES PATENTS

| | | | |
|---|---|---|---|
| 2,692,474 | 10/1954 | Rogner | 57/105 |
| 2,703,261 | 3/1955 | Beck et al. | 57/105 X |
| 3,120,732 | 2/1964 | Stahlecker et al. | 57/105 |
| 3,129,553 | 4/1964 | Weaver | 57/105 X |
| 3,142,146 | 7/1964 | Szaloki | 57/105 |
| 3,382,661 | 5/1968 | Davies | 57/105 |
| 3,479,809 | 11/1969 | Herubel | 57/105 |
| 3,603,069 | 9/1971 | Grieve | 57/105 |

*Primary Examiner*—Donald E. Watkins
*Attorney, Agent, or Firm*—Mills and Coats

[57] ABSTRACT

In abstract, a preferred embodiment of this invention is a drive tape tension assembly for use with textile spinning and twisting machines. This assembly is constructed primarily of spring steel and gives the desired control and stops while at the same time eliminating much apparatus heretofore needed to accomplish the same results.

7 Claims, 4 Drawing Figures

TENSION PULLEY ASSEMBLY FOR TEXTILE SPINNING MACHINES

This invention relates to textile equipment and more particularly to tensioning means for the spindle drives of textile spinning and twisting machines.

In the past, various means have been employed in creating the tension necessary for proper operation of the endless drive belts or tapes used on textile spinning and twisting machines or frames. These tapes generally operate from the rotatable tape drive pulley or drum and drive a plurality of upright spindles by passing about the whirl components thereof.

The early tensioning devices were in the form of simple weighted means that applied tension directly proportional to the weight use. As equipment became more sophisticated, complex toggle lever systems were developed using either air or enclosed coil spring means to acquire the proper tension biasing. The same problems encountered with these latter devices were inherent in the early weight devices, namely, variations of tension from one drive system to the other on the same frame.

After much research and study into the above mentioned problems, the present invention has been developed which eliminates much of the complex pivot linkages and biasing sources of earlier systems while providing a superior operating, simpler constructed tension pulley assembly. The assembly of the present invention is formed from a single piece of spring steel with the shape of the same providing inherent stops where necessary.

In view of the above, it is an object of the present invention to provide a spindle drive tension assembly for textile spinning type machines which is constructed from a single base part.

Another object of the present invention is to provide a tensioning device for spinning frames which gives easy accessibility for mounting adjustments.

Another object of the present invention is to provide a tensioning device for textile spinning frames which is simple in construction, easy to assemble and inexpensive to maintain.

Another object of the present invention is to provide a tension pulley assembly for textile spinning frames which is constructed from a single piece of spring steel and yet operates in a superior manner to prior known assembly of this type.

A further object of the present invention is to provide a pulley tension assembly for spinning frames which is simple to install and adjust and yet superior in operational function.

Another object of the present invention is to provide a pulley tension assembly for textile spinning frames which eliminates complex weight and spring apparatus with a single, one piece unit that functions superiorly.

Another object of the present invention is to provide, in a tension pulley assembly for textile spinning frames, an improved pulley assembly, including a molded in grease nipple.

Other objects and advantages of the present invention will become apparent and obvious from a study of the following description and the accompanying drawings which are merely illustrative of such invention.

IN THE DRAWINGS

Figure 1:
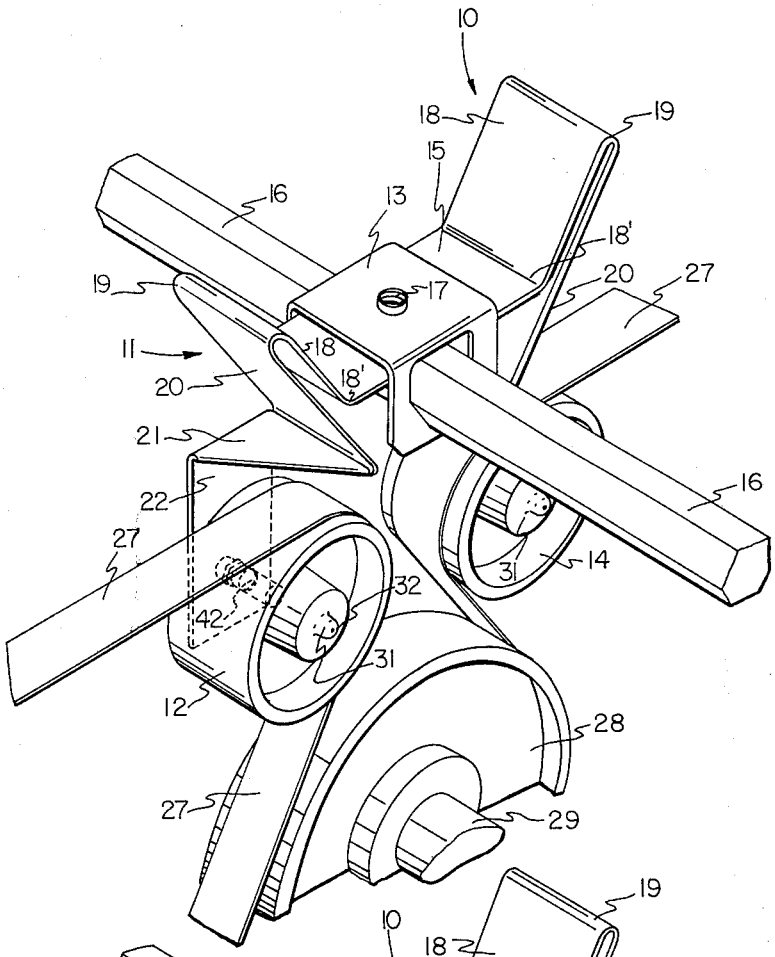
FIG. 1 is a front perspective view of a tension pulley assembly of the type used with textile spinning frames showing a preferred embodiment of the present invention.

With further reference to the drawings, the pulley tension assembly of the present invention indicated generally at 10, in the embodiment disclosed in FIG. 1, composed of a single piece of spring steel indicated generally at 11 which extends from one idler pulley 12, through generally U-shaped mounting bracket 13, to second idler pulley 14.

The spring body 11 is formed with a central flat portion 15 which passes beneath bracket 13 and is held in adjustable fixed relation between such bracket and support bar 16 by a means such as set screw 17. The support bar is a standard part found on textile spinning and twisting frames such as the Roberts Company "Ranger" brand units. These units or frames are well known to those skilled in the art and further details and description thereof is not deemed necessary.

An upward break 18 (as oriented in the drawings) is formed at each end of central portion 15 of tension spring 11. At point 19, the uppermost ends of upward break 18, the tension spring is turned back on itself to form downward leg 20.

Tension spring 11 at the lower end of leg 20 includes a break at a slightly acute angle to form an outwardly projecting portion 21.

Figure 2:
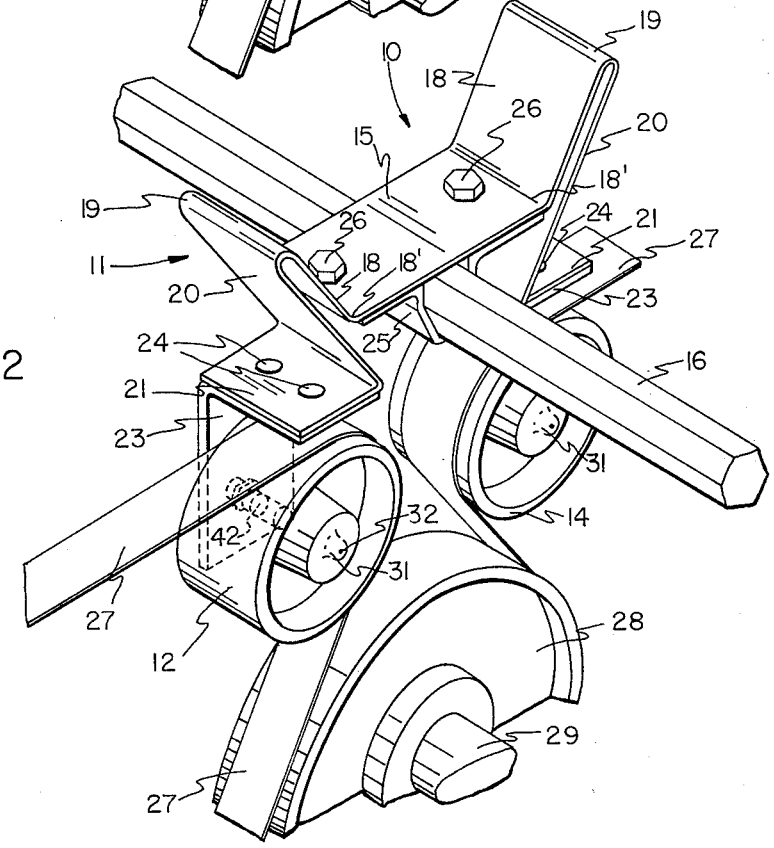
FIG. 2 is a front elevational view of a modification of such assembly.

In the embodiment of FIG. 1, spring 11 is then formed back on itself at a 45° angle as seen clearly in FIG. 1 with a downward break at 90° to form pulley mounting leg 22. In the embodiment of FIG. 2 an L-shaped bracket 23 is secured to portion 21 by means such as rivets 24. This bracket 23 mounts the respective idler pulleys 12 or 14 as the case may be.

A second difference found in the embodiment of FIG. 2 is that a strap-eye shaped bracket 25 is secured to central portion 15 by means such as bolts 26 rather than the bracket 13 and set screw 17 used in the FIG. 1 embodiment.

A standard endless drive belt or tape 27 passes over one of the idler pulleys, around main drive pulley or drum 28 of main drum 29 of the spinning frame (not shown, over the other idler pulley, about the standard whirls (not shown) of the spindles (not shown) of the spinning frame and return.

Each of the idler pulleys 12 and 14 are formed of a one piece plastic body 30 with a central bulbous portion 31 on the exterior side thereof. An axial opening 32 to receive grease is formed in bulbous or nipple portion 31. A bearing receiving bore opening 33 is provided in the back side of the pulley body 30 and communicates with opening 32. This bore 33 contains an interior groove 34. A threaded tension pulley stud 35 includes a smooth bearing portion 36. A grease groove 37 is provided adjacent the bearing portion 36 with an enlarged retaining head 38 terminating adjacent grease opening 32.

Figure 4:
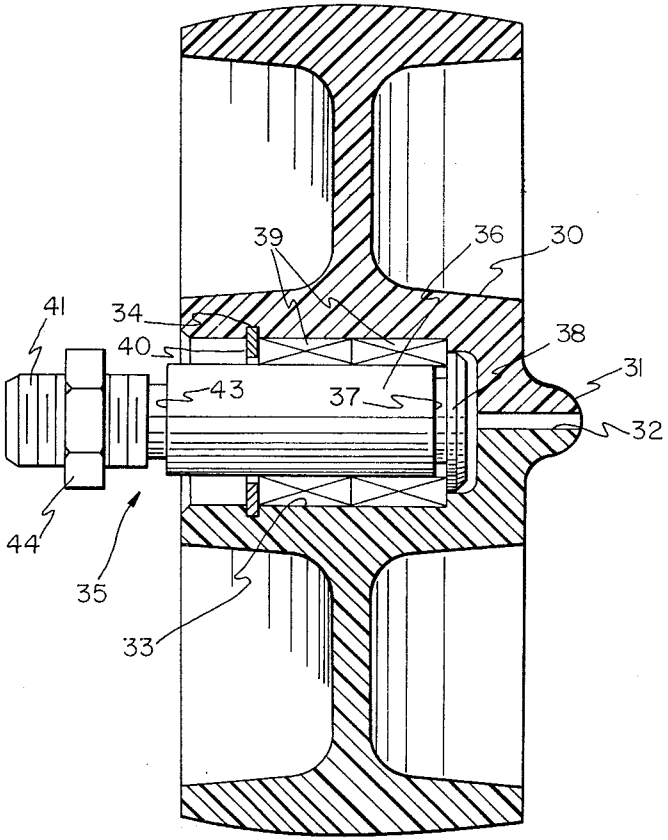
FIG. 4 is a section taken through lines 4—4 of FIG. 3.
Figure 3:
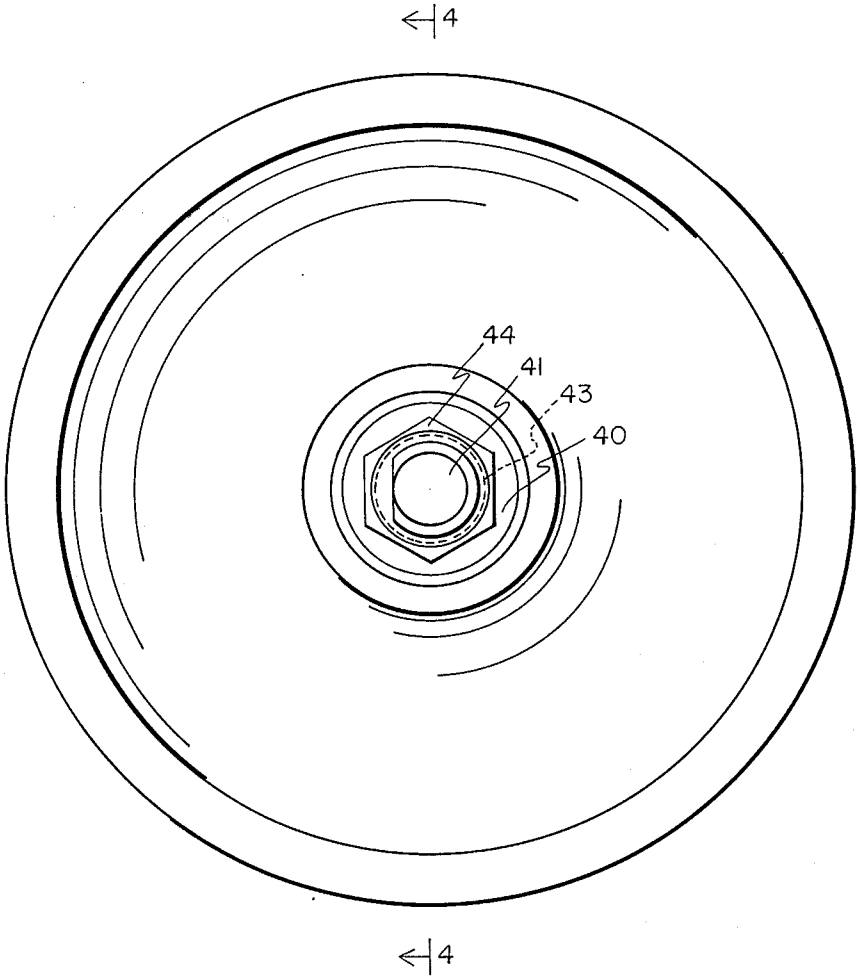
FIG. 3 is an enlarged rear elevational view of the pulley assembly used in conjunction with the tension assembly of the present invention.

A plurality of needle bearings 39 are placed between bearing portion 36 of pulley mounting stud 35 and the inside of bore opening 33. These needle bearings are retained in operative position by an industrial type retaining ring 40 which is adapted to be inserted in interior groove 34. As can clearly be seen in the sectional view of FIG. 4, the needle bearings extend between retaining head 38 and retaining ring 40 to give an easily rotatable idler pulley.

Because there is a space between the end of grease opening 32 and retaining head 38 in bore opening 33, grease that is forced under pressure through opening 32 will surround retaining head 38 and fill grease groove 37. The lubricant from this groove will lubricate needle bearings 39 as the idler pulley rotates in operation. Because of the particular structure of the retaining head and grease groove in the end of tension pulley stud 35, the standard grease fitting thought necessary for pulleys of this type can be eliminated. Although this may appear to be a minor improvement in the art, it must be kept in mind that due to the large number of idler pulleys of this type required in spinning operations, the savings over a period of time are great.

The idler pulleys 12 and 14 are mounted to their respective downward leg 20 or bracket 23, as the case may be, by inserting the threaded end 41 of pulley mounting stud 35 through a precut hole 42 which abuts shoulder 43 of the stud. Retaining bolt 44 securedly retains the pulley assembly in operative position on the tension assembly.

In use of the tension assembly of the present invention, the downward leg 20 does not normally contact its respective upward break 18. The curved point 18' of the break actually acts as a bumper stop for inward movement of the respective pulley with such pulley being allowed to move in the opposite direction against the bias of the spring. Thus to prevent excessive wear, leg 20 is not in normal contact with bumper stop 18' but is so only at times when it is necessary to prevent the pulleys from moving inwardly and clashing thereby causing possible damage thereto.

By viewing the drawings it can readily be seen that leg 20 pivots in a hinge type action about point 19 to give the tension bias to the respective pulley associated therewith.

From the above, it can be seen that the unique shape of the tension spring body 11 allows the same to act as a bumper stop against the respective idler pulley moving in one direction while at the same time allowing tensioned bias movement in the opposite direction. Thus, through the use of a single piece of spring steel formed into the shape described, a highly efficient tension assembly is formed which is superior to prior known, much more complex, devices and yet is inexpensive to manufacture.

In view of the above, it is obvious that the present invention has the advantage of providing a relatively inexpensive and yet highly efficient idler pulley tension assembly for textile spinning frames. Because there are no mechanical parts to wear, the assembly of the present invention has the further advantage of being almost completely maintenance free. The improved pulley assembly used in conjunction with the tension assembly is less expensive to produce and yet is equal with or superior to prior known pulley assemblies that required special grease fitting devices.

The terms "upper", "lower", and so forth have been used herein merely for convenience to describe the tension assembly and its parts as oriented in the drawings. It is to be understood, however, that these terms are in no way limiting to the invention since the assembly may obviously be disposed in many different positions when in actual use.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A drive tape tension pulley assembly of the type used on textile spinning frames comprising: means for attaching said assembly to a support bar means of said frame; and a resiliently flexible unitary tensioning and support means extending from said attaching means and operatively mounting at least one pulley means, the main tensioning effect of the assembly being a J-shaped portion of said unitary tension support means which is inherently limited in movement in one direction but is tensionly moveable in the opposite direction whereby both mounting support and drive tape tension is imparted to said pulley.

2. The assembly of claim 1 wherein at least two pulleys are operatively supported by said unitary means.

3. The assembly of claim 1 wherein said unitary tension support means is formed from stip type spring steel.

4. The assembly of claim 3 wherein at least two pulleys are operatively supported by said unitary means.

5. A drive tape tension pulley assembly of the type used on textile spinning frames comprising: means for attaching said assembly to a support bar means of said frame; and a resiliently flexible unitary tensioning support means extending from said attaching means and operatively mounting at least one pulley means, said tension and support means includes a movement stop for said mounting pulley in one direction whereby pulley clashing is prevented in one direction while tensioning movement is provided in the opposite direction.

6. The assembly of claim 1 wherein a grease fittingless pulley is provided.

7. The assembly of claim 6 wherein a nipple having an axial opening therein is integrally formed into the body of said pulley whereby being lubricating grease can be forced into the interior of said pulley.

* * * * *